US010721795B2

(12) United States Patent
Noda et al.

(10) Patent No.: US 10,721,795 B2
(45) Date of Patent: Jul. 21, 2020

(54) WINDOW ASSEMBLY COMPRISING CONDUCTIVE TRANSPARENT LAYER AND CONDUCTIVE ELEMENT IMPLEMENTING HYBRID BUS-BAR/ANTENNA

(71) Applicant: AGC Automotive Americas R&D, Inc., Ypsilanti, MI (US)

(72) Inventors: Jun Noda, Canton, MI (US); Frederick Schaible, III, Grosse Pointe Park, MI (US); Jesus Gedde, Dexter, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 340 days.

(21) Appl. No.: 15/899,506

(22) Filed: Feb. 20, 2018

(65) Prior Publication Data

US 2019/0261464 A1 Aug. 22, 2019

(51) Int. Cl.

| | |
|---|---|
| ***H05B 3/86*** | (2006.01) |
| ***H01Q 1/12*** | (2006.01) |
| ***H01Q 13/10*** | (2006.01) |
| ***H05B 3/84*** | (2006.01) |
| ***H01Q 1/46*** | (2006.01) |

(52) U.S. Cl.

CPC ..... *H05B 3/86* (2013.01); *H01Q 1/1278* (2013.01); *H01Q 1/1285* (2013.01); *H01Q 13/10* (2013.01); *H01Q 13/103* (2013.01); *H05B 3/84* (2013.01); *H01Q 1/46* (2013.01); *H01Q 13/106* (2013.01); *H05B 2203/011* (2013.01); *H05B 2203/013* (2013.01)

(58) Field of Classification Search

CPC ..... H05B 3/86; H05B 3/84; H05B 2203/001; H05B 2203/013; H01Q 1/1271; H01Q 1/1278; H01Q 1/1285; H01Q 1/46; H01Q 13/10; H01Q 13/103; H01Q 13/106

USPC ..... 219/203

See application file for complete search history.

(56) References Cited

U.S. PATENT DOCUMENTS

| | | | |
|---|---|---|---|
| 5,898,407 | A | 4/1999 | Paulus et al. |
| 8,836,592 | B2 | 9/2014 | Paulus et al. |
| 8,941,545 | B2 | 1/2015 | Kagaya et al. |
| D747,298 | S | 1/2016 | Lee et al. |
| 9,337,525 | B2 | 5/2016 | Dai |

(Continued)

FOREIGN PATENT DOCUMENTS

| | | | |
|---|---|---|---|
| EP | 3249745 | A1 | 11/2017 |
| WO | 2015112135 | A1 | 7/2015 |

*Primary Examiner* — Tuan N Nguyen

(74) *Attorney, Agent, or Firm* — Howard & Howard Attorneys PLLC

(57) ABSTRACT

A window assembly comprises a substrate with a transparent layer that defines an area having a periphery. An outer region devoid of the transparent layer is defined adjacent the transparent layer along the periphery. A conductive element disposed on the substrate and comprises a first portion overlapping an area of the transparent layer and abutting and being in direct electrical contact with the transparent layer. The conductive element further comprises a second portion integrally extending from the first portion and disposed in the outer region. The periphery of the transparent layer delineates the first and second portions of the conductive element. The second portion has an area defining an enclosed slot. A feeding element couples to the conductive element for energizing the enclosed slot as a slot antenna. An energizing element couples to the conductive element for energizing the conductive element to implement a bus bar.

20 Claims, 8 Drawing Sheets

(56) References Cited

U.S. PATENT DOCUMENTS

| | | | |
|---|---|---|---|
| 9,406,996 | B2 | 8/2016 | Lee et al. |
| D771,602 | S | 11/2016 | Lee et al. |
| D774,024 | S | 12/2016 | Lee et al. |
| 9,647,319 | B2 | 5/2017 | Lee et al. |
| 9,755,300 | B2 | 9/2017 | Kagaya et al. |
| 2015/0207203 | A1 | 7/2015 | Lee et al. |
| 2016/0006112 | A1 | 1/2016 | Kagaya et al. |
| 2016/0254586 | A1 | 9/2016 | Shimo et al. |
| 2016/0308268 | A1 | 10/2016 | Lee et al. |

WINDOW ASSEMBLY COMPRISING CONDUCTIVE TRANSPARENT LAYER AND CONDUCTIVE ELEMENT IMPLEMENTING HYBRID BUS-BAR/ANTENNA

BACKGROUND

1. Technical Field

The disclosure relates to a window assembly comprising a conductive transparent layer, and more specifically, the window assembly comprising a conductive element implemented as a hybrid antenna/bus bar.

2. Description of the Related Art

Recently, there is increasing demand for vehicle windshields to have an electrically conductive transparent layer embedded within the windshield for various purposes, such as reflecting infrared radiation from sunlight penetrating the windshield. In so doing, the transparent layer reduces the amount of infrared radiation entering an interior of the vehicle. As a result, during warm months, less energy is required to lower the interior temperature of the vehicle.

One or more antennas are frequently incorporated on or within the windshield having such transparent layer. Accommodating the antenna(s) when the transparent layer is present is a difficult task. Firstly, the transparent layer is typically applied over a substantial part of the windshield, often spanning the entire field of view of the driver. This is done to maximize efficiency of the transparent layer to reflect infrared radiation. Furthermore, the transparent layer is conductive, and therefore, has an electromagnetic impact on radio waves, such as radio waves propagating to or from the antenna(s). Consequently, there remains little room on the windshield to place the antenna(s) without encountering detrimental electromagnetic interference. Additionally, tolerances between the antenna(s) and the transparent layer are difficult to manage and the slightest deviation in such tolerances can have significant impact on antenna performance.

Additionally, one or more bus bars are frequently incorporated on or within the windshield having such transparent layer. The bus bars transfer electrical current through the transparent layer to generate heat for defrosting or defogging. The material composition and size of the bus bars determine the amount of current that can be carried through the transparent layer. The bus bars typically exhibit a large footprint to sufficiently heat the transparent layer. As previously mentioned, the transparent layer is often applied over a substantial part of the windshield. Consequently, the room available on the window to incorporate the antenna(s) is further reduced by presence of the bus bars.

Moreover, there is a need to incorporate slot antennas on window assemblies comprising transparent layers. Prior slot antennas are typically formed in a non-conductive outer region between an edge of the transparent layer and the conductive window frame of the vehicle, which holds the window assembly. By depending on the window frame to form the slot antenna, prior techniques require the slot antenna to occupy a substantial portion or entirety of the outer region. In turn, the slot antenna of the prior configurations interferes with other antennas that may otherwise need to be placed in the outer region. As a result, space available in the outer region for other antennas is minimized where the slot antenna is formed, in part, by the window frame. Moreover, directly implicating the vehicle chassis to form the slot antenna increases susceptibility to noise, increases the slot footprint, and adds complexity to design and assembly of the window.

Therefore, there remains the opportunity to develop a window assembly that solves at least the aforementioned problems.

SUMMARY AND ADVANTAGES

A window assembly is provided. The window assembly includes a substrate and a transparent layer disposed on the substrate. The transparent layer comprises a metal compound such that the transparent layer is electrically conductive. The transparent layer defines an area having a periphery. An outer region devoid of the transparent layer is defined adjacent to the transparent layer along the periphery. A conductive element is disposed on the substrate. The conductive element comprises a first portion overlapping an area of the transparent layer and a second portion integrally extending from the first portion. The first portion abuts and is in direct electrical contact with the transparent layer. The second portion is disposed in the outer region such that the periphery of the area of the transparent layer delineates the first portion from the second portion. The second portion has an area defining an enclosed slot. The enclosed slot is spaced from a frame of the window and entirely surrounded by the outer region. A feeding element is coupled to the conductive element for energizing the conductive element to implement the enclosed slot as a slot antenna. An energizing element is coupled to the conductive element for energizing the conductive element to implement the conductive element as a bus bar. The bus bar transfers energy to heat the transparent layer.

The window assembly advantageously comprises the transparent layer for reflecting infrared radiation while simultaneously providing the conductive element exhibiting a hybrid slot antenna/bus bar configuration. The conductive element beneficially plays a dual role by implementing the enclosed slot as a slot antenna and by implementing the bus bar to heat the transparent layer.

The slot antenna also has broad frequency application and the bus bar exhibits sufficient conductivity to heat the transparent layer. The conductive element advantageously provides a greater control over conductivity, radiation patterns, and impedance characteristics of the window assembly. The conductive element further allows for versatility in geometric designs of the enclosed slot and the bus bar.

Moreover, the conductive element provides an elegant solution to reduce space available in the outer region of window assemblies having transparent layers. By implementing the enclosed slot in the outer region, reliance on the conductive window frame of the vehicle to form the slot antenna is avoided and the footprint of the slot antenna is reduced. The conductive element can provide the dual antenna/bus bar capabilities while reducing the need of the slot antenna to occupy a substantial portion or entirety of the outer region. In turn, the slot antenna avoids interference with other antennas that may otherwise need to be placed in the outer region. Moreover, the slot antenna reduces susceptibility to noise from the vehicle chassis and simplifies design and assembly of the window.

Those skilled in the art appreciate that the subject invention may exhibit or provide other advantages not specifically recited herein.

DETAILED DESCRIPTION

I. Window Assembly Overview

Figure 1:
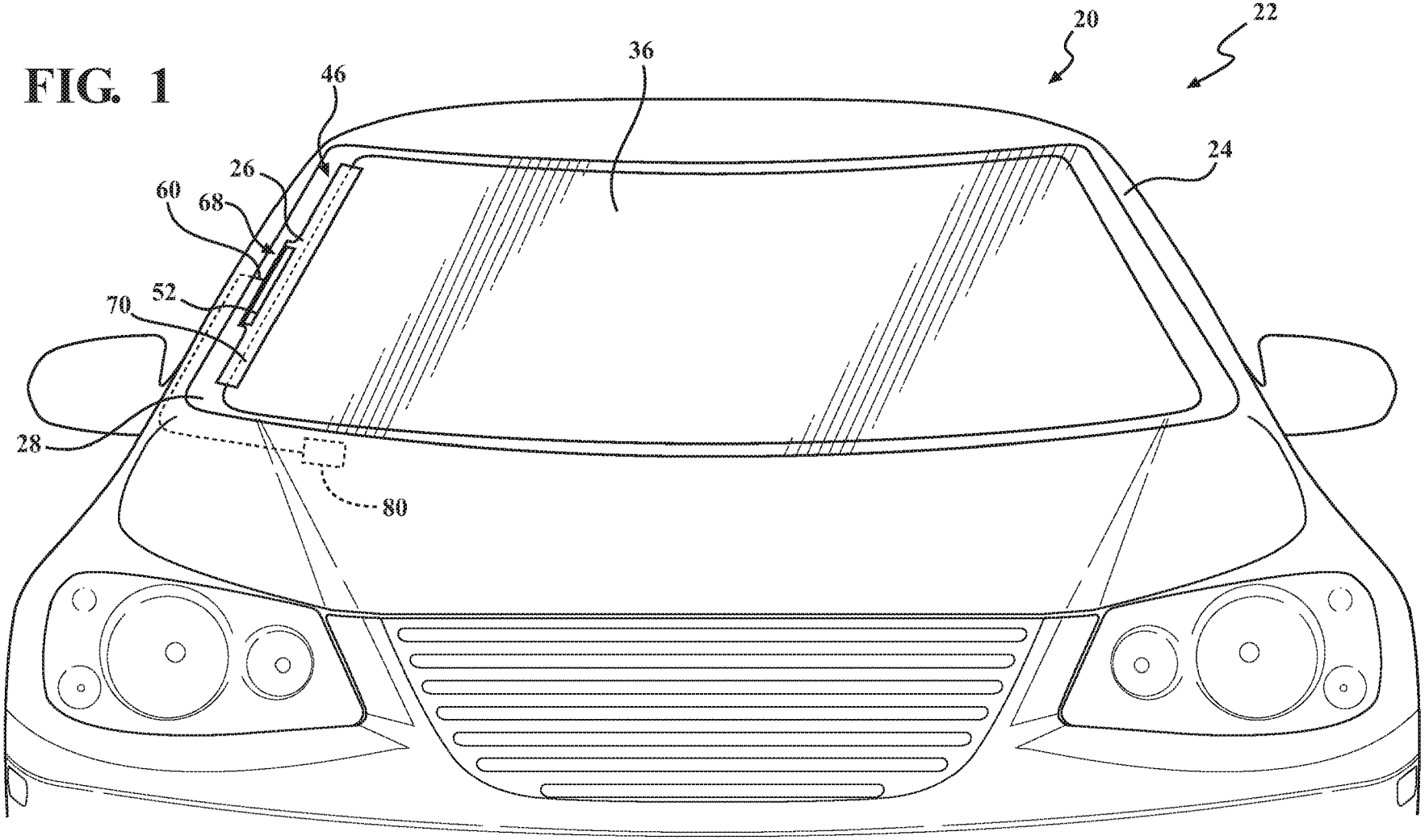
FIG. 1 is a perspective view of a vehicle with a window assembly having a transparent layer disposed on a substrate defining an area having a periphery and with a plurality of conductive elements each disposed on the substrate, according to one example.

Referring to the Figures, wherein like numerals indicate corresponding parts throughout the several views, a window assembly is generally shown at 20. As shown in FIG. 1, the window assembly 20 is for a vehicle 22. The window assembly 20 may be a front (windshield) as illustrated in FIG. 1. Alternatively, the window assembly 20 may be a rear window (backlite), a roof window (sunroof), or any other window of the vehicle 22. Typically, the vehicle 22 defines an aperture and the window assembly 20 closes the aperture. A window frame 24 of the vehicle 22, which is electrically conductive, conventionally defines the aperture. The window assembly 20 may be for applications other than for vehicles. For example, the window assembly 20 may be fore architectural applications such as homes, buildings, and the like.

As shown throughout the Figures, the window assembly 20 includes a conductive element 26. In one configuration, as shown in FIG. 1, the window assembly 20 may also include a plurality of conductive elements 26. As will be described in detail below, the conductive element 26 may transmit or receive radio frequency signals and/or transfer energy to heat the window assembly 20.

Figure 2:
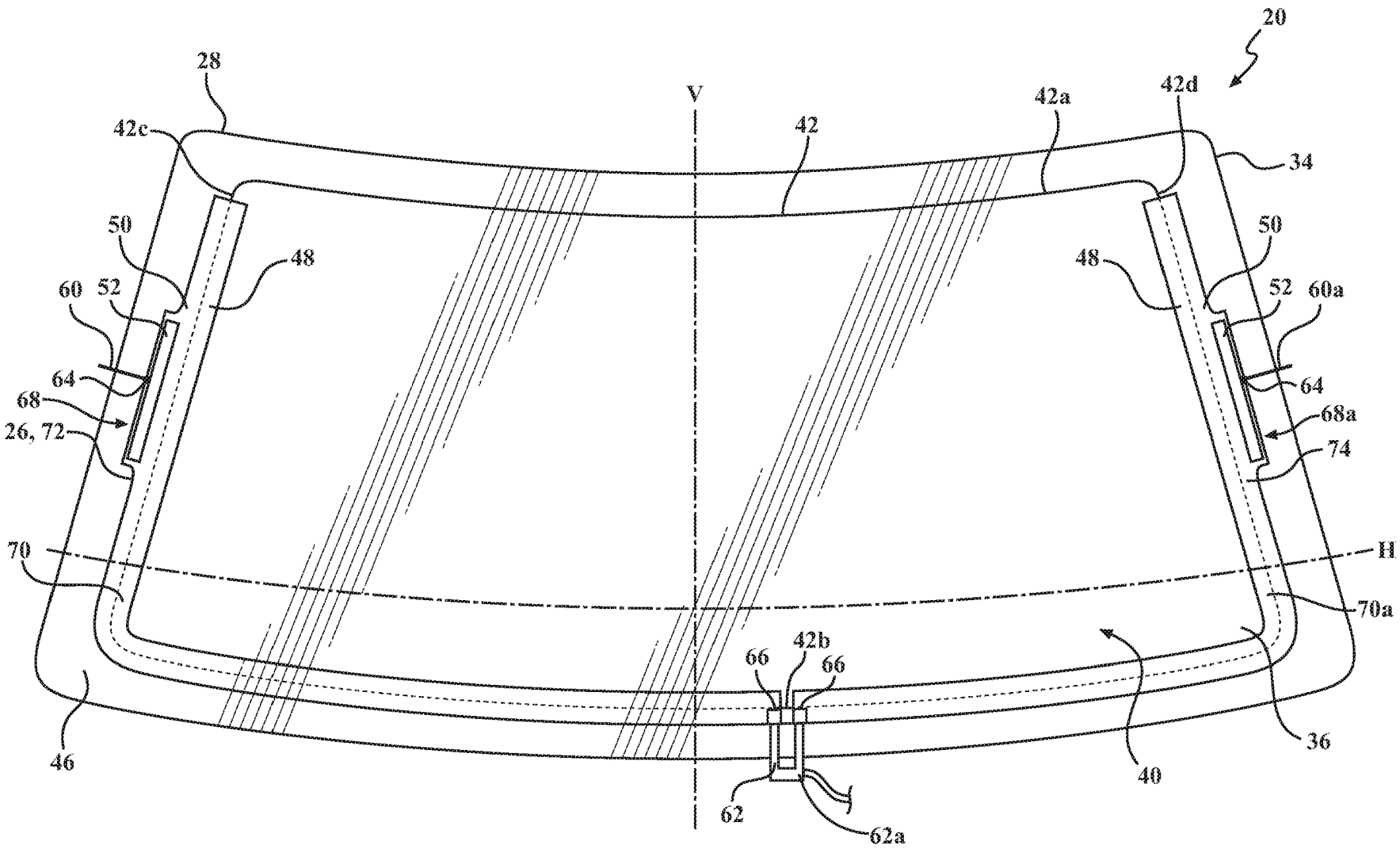
FIG. 2 is a plan view of the window assembly having the conductive element, the transparent layer and the feeding element, according to one example.
Figure 3:
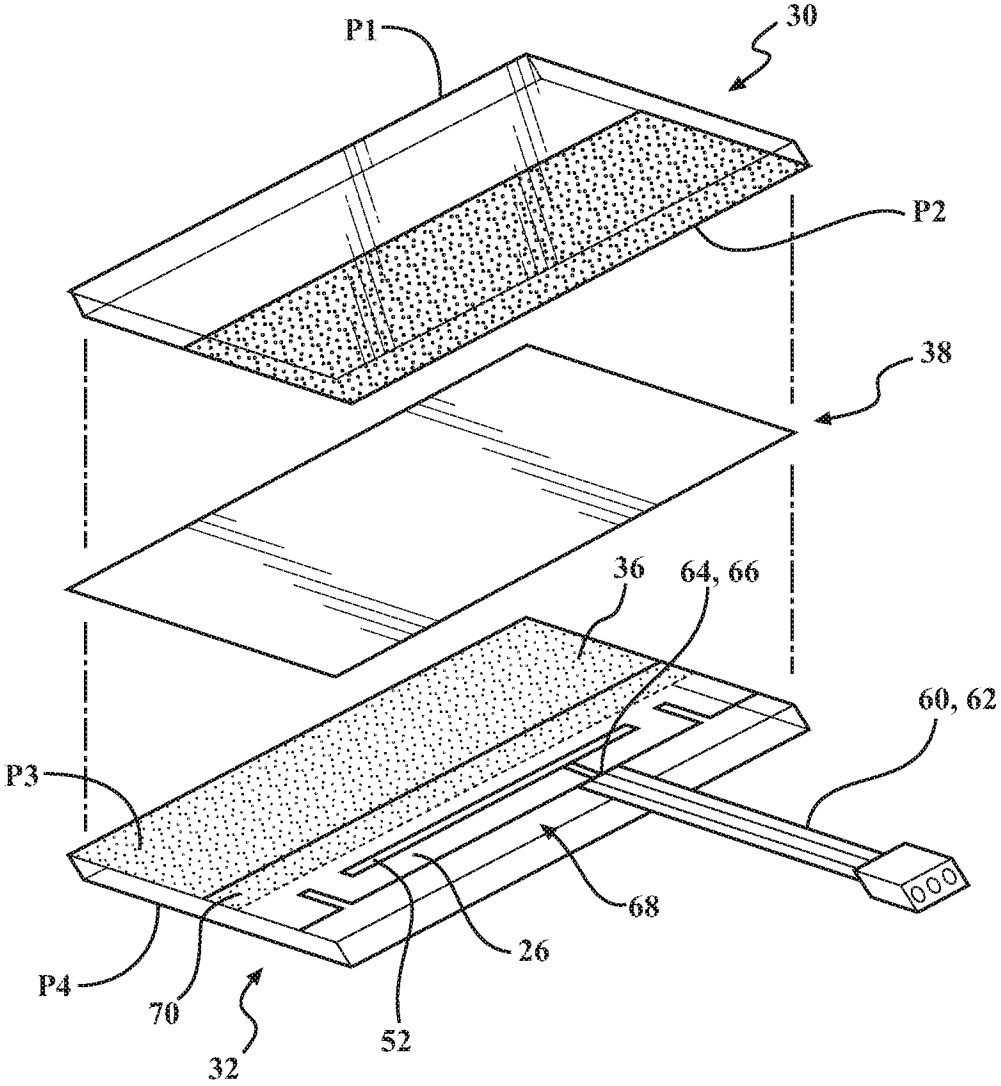
FIG. 3 is an assembly view of the window assembly with an interlayer, the transparent layer, the conductive element and the feeding element sandwiched between the exterior and interior substrate, according to one example.

As shown in FIGS. 1 and 2, the window assembly 20 includes a substrate 28. In one example, as shown in FIG. 3, the window assembly 20 includes an exterior substrate 30 and an interior substrate 32 disposed adjacent the exterior substrate 30. As such, the substrate 28 includes a combination of the exterior and interior substrates 30, 32. In another example, the substrate 28 may comprise a single layer. The substrate 28 may have other configurations not specifically recited herein.

Figure 5:
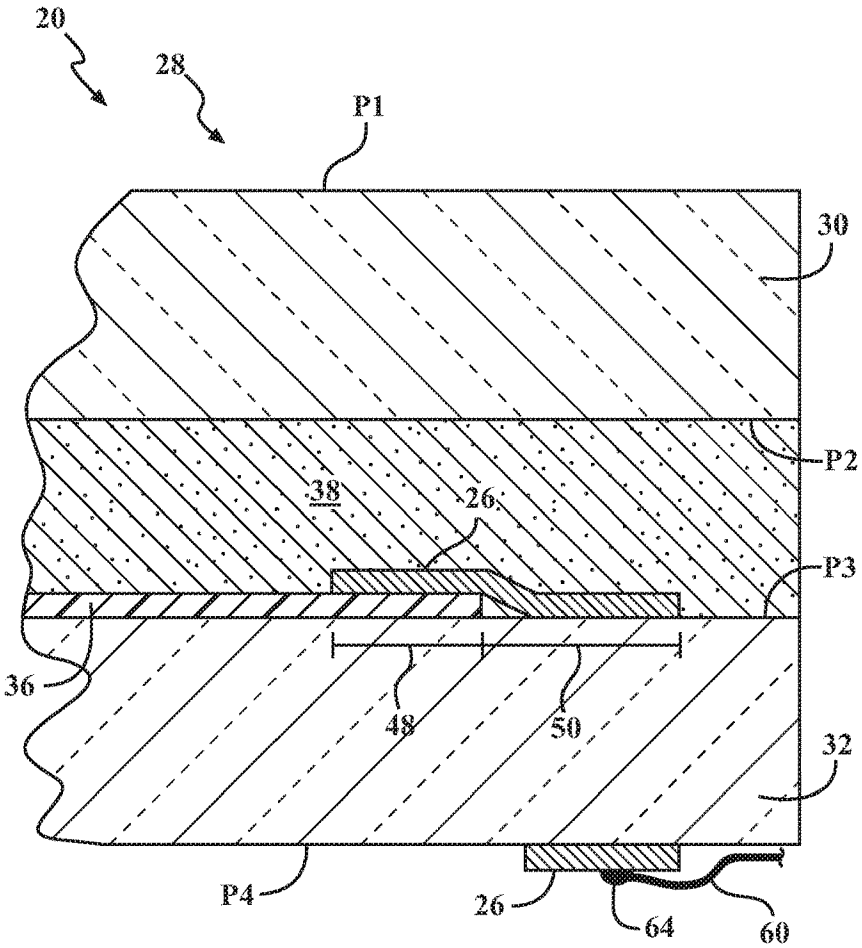
FIG. 5 is a cross-sectional partial view of the window assembly having the transparent layer and the conductive element sandwiched between the exterior and interior substrates of the window assembly and with the feeding element spaced from and capacitively coupled to the conductive element, according to one example.
Figure 4:
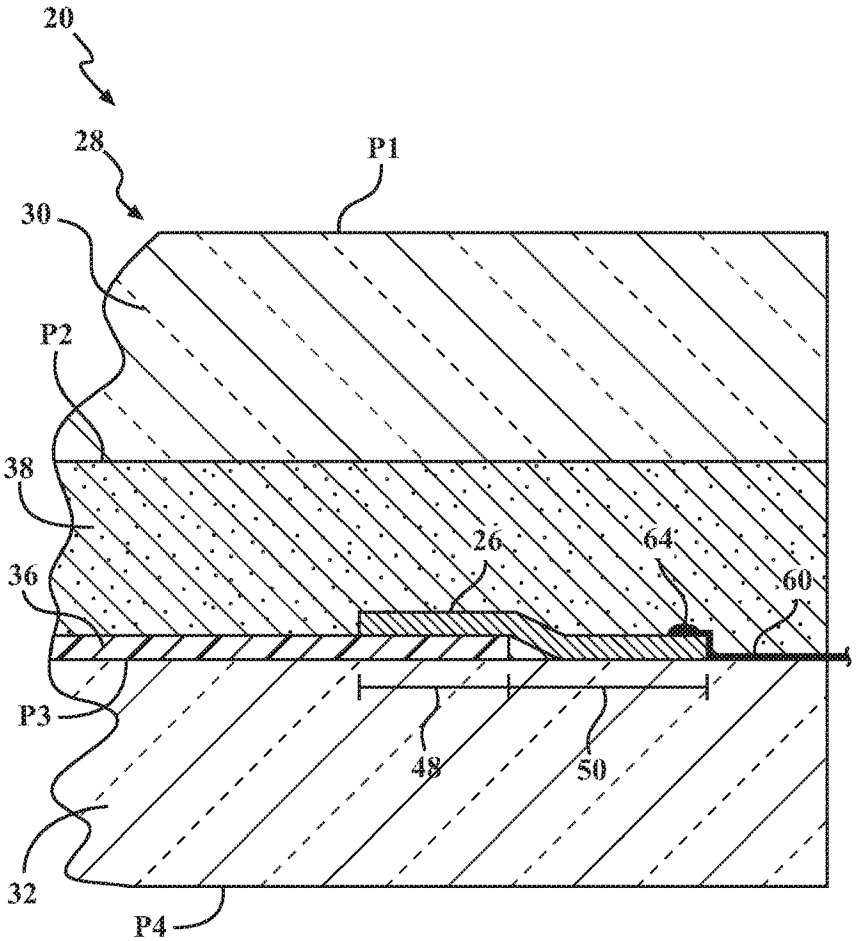
FIG. 4 is a cross-sectional partial view of the window assembly having the transparent layer, the conductive element, and a feeding element sandwiched between exterior and interior substrates of the window assembly, according to one example.

In FIGS. 3-5, the exterior substrate 30 is disposed parallel to and spaced from the interior substrate 32 such that the substrates 30, 32 are not contacting one another. Alternatively, the exterior substrate 30 may directly abut the interior substrate 32.

Typically, the exterior and interior substrates 30, 32 are electrically non-conductive. As mentioned herein, the term "non-conductive" refers generally to a material, such as an insulator or dielectric, that when placed between conductors at different electric potentials, permits a negligible current flow through the material. The exterior and interior substrates 30, 32 are also substantially transparent to light. However, it is to be appreciated that the exterior and interior substrates 30, 32 may be colored or tinted and still be substantially transparent to light. As used herein, the term "substantially transparent" is defined generally as having a visible light transmittance of greater than sixty percent.

The exterior and interior substrates 30, 32 are preferably joined together to form the window assembly 20. In one configuration, the exterior and interior substrates 30, 32 are panes of glass. The panes of glass are preferably automotive glass and, more preferably, soda-lime-silica glass. However, the exterior and interior substrates 30, 32 may be plastic, fiberglass, laminate or other suitable electrically non-conductive and substantially transparent material. For automotive applications, the exterior and interior substrates 30, 32 are each typically 3.2 mm thick. However, the exterior and interior substrates 30, 32 may have any suitable thickness.

In FIGS. 3-5, the exterior substrate 30 has an outer surface P1 and an inner surface P2. Similarly, the interior substrate 32 has an inner surface P3 and an outer surface P4. The outer surface P1 of the exterior substrate 30 faces an exterior of the vehicle 22 when the window assembly 20 is installed in the vehicle 22. The respective inner surfaces P2, P3 of the exterior and interior substrates 30, 32 face one another when the exterior and interior substrates 30, 32 are joined together to form the window assembly 20. The outer surface P1 faces an interior of the vehicle 22 when the window assembly 20 is installed in the vehicle 22.

The exterior and interior substrates 30, 32 define a peripheral edge 34 of the window assembly 20. Conventionally, the peripheral edge 34 of the window assembly 20 is shared by the exterior and interior substrates 30, 32. Specifically, the exterior and interior substrates 30, 32 have substantially similar areas and shapes with each substrate 30, 32 having an edge forming part of the peripheral edge 34 when the substrates 30, 32 are joined. The peripheral edge 34 may have any suitable shape, such as a rectangular or oblong configuration, and the like.

As shown throughout the Figures, a transparent layer 36 is disposed on the substrate 28. In FIG. 4, the transparent layer 36 is disposed between the exterior and interior substrates 30, 32. The window assembly 20 may include the transparent layer 36 sandwiched between the exterior substrate 30 and the interior substrates 32 such that the transparent layer 36 is abutting the substrates 30, 32. For example, the transparent layer 36 may be disposed on one of, or between, the inner surfaces P2, P3. Disposal of the transparent layer 36 between the exterior and interior substrates 30, 32 protects the transparent layer 36 from direct contact with environmental factors, such as snow, ice, debris, and the like, which may damage the transparent layer 36. Alternatively, the transparent layer 36 may be disposed on the outer surface P1 of the exterior substrate 30 or the outer surface P4 of the interior substrate 32.

Although not required, an interlayer 38 may be disposed between the exterior and interior substrates 30, 32 as illustrated in FIGS. 3-5. The window assembly 20 may include the exterior and interior substrates 30, 32 having the transparent layer 36 and interlayer 38 sandwiched therebetween. The interlayer 38 bonds the exterior and interior substrates 30, 32, and prevents the window assembly 20 from shattering into loose fragments upon impact. The interlayer 38 is substantially transparent to light and typically includes a polymer or thermoplastic resin, such as polyvinyl butyral (PVB). Other suitable materials for implementing the interlayer 38 may be used.

The transparent layer 36 may be disposed adjacent to the interlayer 38. In one configuration, as shown in FIGS. 3 and 4, the transparent layer 36 is disposed between the interlayer 38 and the inner surface P3 of the interior substrate 32. In FIGS. 3-5, the transparent layer 36 and the interlayer 38 are sandwiched between the exterior and interior substrates 30, 32 such that the interlayer 38 and the transparent layer 36 are abutting the inner surfaces P2, P3. The transparent layer 36 and interlayer 38 may be disposed or layered according to any suitable configuration not specifically referenced herein.

The transparent layer 36 is substantially transparent to light. Accordingly, a driver or occupant of the vehicle 22 can see through the transparent layer 36 when the window assembly 20 is installed in the vehicle 22. With the transparent layer 36 disposed on the substrate 28, the window assembly 20 exhibits, in one example, greater than sixty percent visible light transmission through the window assembly 20. The transparent layer 36 preferably reflects heat from the sunlight penetrating the window assembly 20. In particular, the transparent layer 36 reduces transmission of infrared radiation through the window assembly 20. Such infrared radiation is typically present in sunlight penetrating the window assembly 20.

In one configuration, the transparent layer 36 is a film. In another configuration, the transparent layer 36 is a coating. The transparent layer 36 may be applied to the surface of the substrate 28 according to any suitable method, such as, chemical vapor deposition, magnetron sputter vapor deposition, spray pyrolysis, and the like.

The term "layer" is not intended to limit the transparent layer 36 to solely a single layer of material. The transparent layer 36 may include or be formed from one or more coatings of films of selected composition. The coatings or films forming the transparent layer 36 may be single or multiple layers. For instance, if the transparent layer 36 is energized or configured to operate as an active antenna element, the transparent layer 36 may comprise three layers, e.g., two silver print layers and one optical dielectric layer between the two silver print layers. In this instance, both the silver prints may have a combined thickness of 10 mm. In another instance, if the transparent layer 36 is not energized or is configured to operate as a passive or parasitic antenna element, the transparent layer 36 may comprise two layers, e.g., a silver print layer and an optical dielectric layer. The transparent layer 36 may comprise or be formed of any number of layers of various different composition to enable the capabilities described herein for the window assembly 20.

The transparent layer 36 includes a metal compound such that the transparent layer 36 is electrically conductive. As mentioned here, the term "electrically conductive" refers generally to a material, such as a conductor, exhibiting electrical conductivity for effectively allowing flow of electric current through the material. Preferably, the metal compound includes a metal oxide. The metal oxide may include a tin oxide, such as indium tin oxide, or the like. However, the transparent layer 36 may include other metal oxides, including, but not limited to, silver oxide. Silver oxide, for example, may be incorporated on a nanometer scale to enable the transparent layer 36 to be transparent to light. The metal compound may also be doped with additive, such as fluorine. Specifically, the additive may be included in the metal compound to optimize the light transmittance and electrical conductivity of the transparent layer 36. The transparent layer 36 may have any suitable sheet resistance or surface resistance. In one example, the transparent layer 36 has a sheet resistance in a range between 0.5-20 SZ/square. Sheet resistances that are below 1 Ω/square may be realized using suitable elemental metals or compounds thereof.

As shown throughout the Figures, the transparent layer 36 defines an area 40. In one configuration, the area 40 spans a majority of the window assembly 20. Specifically, the majority of the window assembly 20 is defined generally as greater than fifty percent of the window assembly 20. More typically, the majority is greater than seventy-five percent of the window assembly 20. The transparent layer 36 may span the majority of the window assembly 20 for maximizing the reduction of transmission of infrared radiation through the window assembly 20.

As shown throughout the Figures, the area 40 of the transparent layer 36 defines a periphery 42. The periphery 42 may define any suitable shape. The periphery 42 may also define any suitable number of edges having any suitable configuration. In one configuration, as shown in FIG. 2, the periphery 42 defines an upper edge 42*a*, an opposing lower edge 42*b*, and a pair of opposing side edges 42*c*, 42*d* connecting the upper and lower edges 42*a*, 42*b*. In one instance, the periphery 42 defines a shape geometrically similar to the peripheral edge 34 of the window assembly 20. In another instance, the periphery 42 is non-linear. For example, the periphery 42 may have protrusions, tabs, indents, etc., which are usually provided for reasons related to assembly or design considerations. However, the periphery 42 may have any suitable shape for spanning the window assembly 20.

As shown throughout the Figures, the periphery 42 further defines a vertical axis, V, extending vertically between the upper and lower edges 42*a*, 42*b* of the periphery 42 and a horizontal axis, H, extending horizontally between the opposing side edges 42*c*, 42*d* of the periphery 42. Such axes V, H are described herein for purposes of providing reference and orientation to certain other components of the window assembly 20. While such axes V, H inherently exist, they may not be readily demarcated or visible on the window assembly 20. Instead, the axes V, H may be defined for geometrical reference (as understood from the Figures) when needed by those skilled in the art to enable the concepts described herein. Thus, the axes V, H are not intended to be physical components of the window assembly 20.

As shown throughout the Figures, an outer region 46 is defined on the window assembly 20. The outer region 46 is devoid of the transparent layer 36. The outer region 46 is defined adjacent to the transparent layer 36 along the periphery 42. In one configuration, the outer region 46 is defined between the periphery 42 of the transparent layer 36 and the peripheral edge 34 of the window assembly 20.

As shown in FIG. 1, the outer region 46 may surround an entirety of the periphery 42 of the area 40 of the transparent layer 36. Having the outer region 46 surround an entirety of the periphery 42 advantageously provides electrical separation between the transparent layer 36 and the window frame 24. Alternatively, the outer region 46 may be defined on predetermined sections of the window assembly 20 such that the outer region 46 is not surrounding the transparent layer 36 continuously along the periphery 42 of the transparent layer 36. For example, the outer region 46 may be defined adjacent to any one or more of the edges of the periphery 42. Additionally, the outer region 46 need not to be continuously defined adjacent to the periphery 42. In other words, the outer region 46 may be defined by a plurality of discrete areas. For example, the outer region 46 may be defined adjacent to the side edges 42*c*, 42*d* of the periphery 42 but not adjacent to the upper and lower edges 42*a*, 42*b* of the periphery 42, or vice-versa.

The outer region 46 has a width defined generally by a distance between the periphery 42 of the transparent layer 36 and the peripheral edge 34 of the window assembly 20. In one configuration, the outer region 46 may separate the transparent layer 36 from the window frame 24 to avoid the possibility of an electrical path being established between the transparent layer 36 and the window frame 24. In other words, the outer region 46 separates the transparent layer 36 and window frame 24 with the transparent layer 36 being electrically disconnected from the electrically conductive window frame 24. Furthermore, the outer region 46 protects the transparent layer 36 by separating the transparent layer 36 from the peripheral edge 34 of the window assembly 20, which is subjected to environmental factors that may degrade the quality of the transparent layer 36.

The outer region 46 may be formed on the window assembly 20 according to any suitable technique known in the art. For instance, the inner surfaces P2, P3 of the exterior and interior substrates 30, 32 may be masked before application of the transparent layer 36 to provide a desired shape of the outer region 46. Alternatively or additionally, the transparent layer 36 may be applied to the window assembly 20 such that the transparent layer 36 is spaced from the peripheral edge 34 of the window assembly 20 to define the outer region 46. Selected portions of the transparent layer 36 may be removed or deleted to provide the desired shape of the outer region 46. Removal or deletion of the selected portions of the transparent layer 36 may be accomplished using any suitable technique or device, such as by lasers, abrasive tools, chemical removal, and the like.

II. Conductive Element Implementing Bus Bar and Antenna

As referenced above, the window assembly 20 includes the conductive element 26. As shown throughout the Figures, the conductive element 26 is disposed on or within the substrate 28. In one configuration, as shown in FIGS. 4 and 5, the conductive element 26 is disposed between the exterior and interior substrates 30, 32. More specifically, as shown in FIG. 5, the conductive element 26 may be disposed between the interlayer 38 and the inner surface P3 of the interior substrate 32. Alternatively, the conductive element 26 may be disposed between the interlayer 38 and the inner surface P2 of the exterior substrate 30. The conductive element 26 may be disposed on the substrate 28 according to other configurations not specifically described herein.

Figure 7:
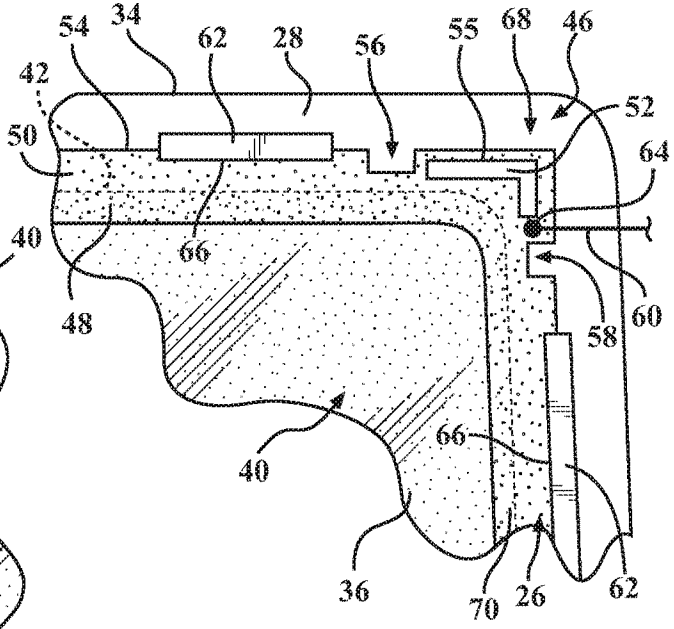
FIG. 7 is a plan view of the window assembly with the conducting element extending around a corner of the transparent layer to abut an upper edge and a side edge of the periphery of the transparent layer, according to one example.
Figure 6:
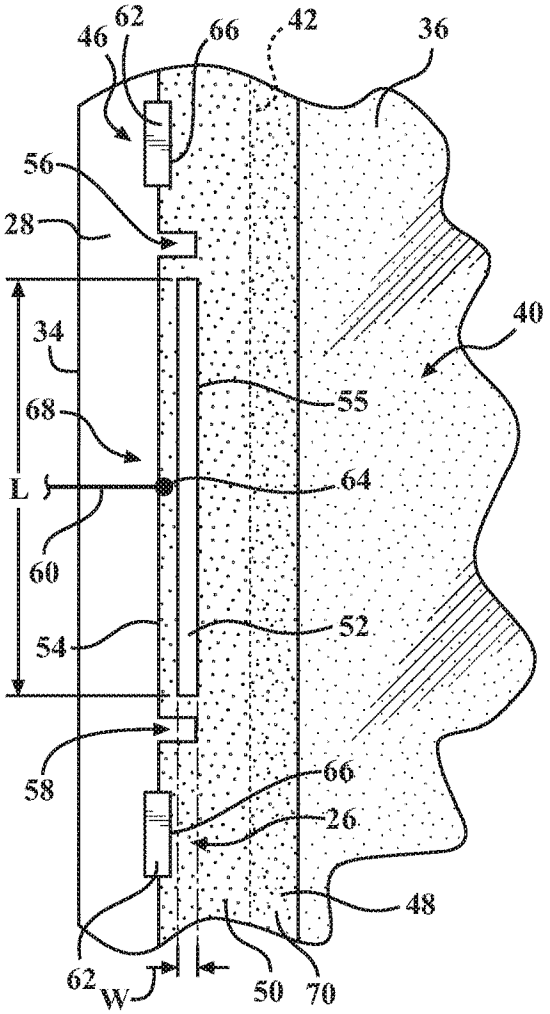
FIG. 6 is a plan view of the window assembly with the conductive element having a first portion overlapping the area of the transparent layer and a second portion integrally extending from the first portion and disposed in an outer region such that the periphery delineates the first portion from the second portion with the second portion having an area defining an enclosed slot and an edge defining a first groove and a second groove spaced apart from one another, according to one example.

As shown throughout the Figures, the conductive element 26 may be elongated and extending along the periphery 42. In one configuration, the conductive element 26 has a rectangular configuration as shown in FIG. 6. The conductive element 26 may be elongated while having configurations other than a rectangular-type configuration. In another configuration, as shown in FIG. 7, the conductive element 26 extends along one of the side edges 42*c*, 42*d* of the periphery 42 and partially along one of the upper and lower perimeter edges of the periphery 42. For example, the periphery 42 of the transparent layer 36 defines a corner where one of the side edges 42*c*, 42*d* of the periphery 42 connects to one of the upper and lower edges 42*a*, 42*b* of the periphery 42. It will be appreciated that the conductive element 26 may have any suitable curvature. In such configurations, the conductive element 26 may bend or curve along the periphery 42 such that the conductive element 26 maintains spacing from the periphery 42 of the area 40 of the transparent layer 36.

The conductive element 26 is electrically conductive. The conductive element 26 may be formed of metallic print, such as silver print. The conductive element 26 may be applied to the window assembly 20 according to any suitable method, such as screen-printing, firing, adhesion and the like.

The conductive element 26 includes a substantially flat configuration. As such, the conductive element 26 may be sandwiched between the exterior and interior substrates 30, 32. In one configuration, as shown in FIG. 4, the conductive element 26 may be disposed on the outer surface P4 of the interior substrate 32. Moreover, the conductive element 26 may be applied to the window assembly 20 without any modification to the area 40 of the transparent layer 36. Furthermore, the conductive element 26 may be formed during or after formation of the area 40 of the transparent layer 36 to the window assembly 20.

The conductive element 26 may have a uniform thickness or a thickness that varies across the surface area of the conductive element 26. The thickness of the conductive element 26 may correspond to the thickness of the area 40 of the transparent layer 36. Alternatively, the conductive element 26 may have any suitable thickness greater than or less than the area 40 of the transparent layer 36.

As shown throughout the Figures, the conductive element 26 includes a first portion 48 and a second portion 50. The first portion 48 of the conductive element 26 overlaps the area 40 of the transparent layer 36. The second portion 50 of the conductive element 26 integrally extends from the first portion 48 of the conductive element 26. In other words, the first and second portions 48, 50 are formed together as a single piece of material. The periphery 42 of the transparent layer 2636 delineates the first portion 48 from the second portion 50 of the conductive element 26. In other words, the area 40 of the transparent layer 36 overlaps the conductive element 26 such that the portion of the conductive element 26 that overlaps the transparent layer 36 is the first portion 48 of the conductive element 26 and the portion of the conductive element 26 that does not overlap the transparent layer 36 (in the outer region 46) is the second portion 50.

The first portion 48 abuts and is in direct electrical contact with the transparent layer 36. The first portion 48 may abut the transparent layer 36 such that a surface of the first portion 48 interfaces with a surface of the transparent layer 36. Additionally, the first portion 48 may be in direct electrical contact with the transparent layer 36 using any suitable technique, such as conductive soldering, conductive adhesives, or by means of the sandwiching the exterior and interior substrates 30, 32, or the like. By abutting the transparent layer 36, a DC connection is provided between the first portion 48 and the transparent layer 36.

The second portion 50 of the conductive element 26 has an area defining an enclosed slot 52. The enclosed slot 52 is devoid of the conductive element 26 such that the enclosed slot 52 may be devoid of conductive material. As used herein, the term "enclosed" means that the slot 52 is surrounded on all sides by the second portion 50 in a 2-D plane of the conductive element 26. The slot 52 is entirely surrounded by the second portion 50 and is encompassed within the outer region 46. As shown throughout the Figures, the enclosed slot 52 is disposed in the outer region 46 and is spaced from the periphery 42 of the area 40 of the transparent layer 36. The enclosed slot 52 is enclosed within the second portion 50 such that the enclosed slot 52 is spaced away from, and does not rely on the window frame 24 to implement the antenna.

The second portion 50 includes an edge 54 and at least one inner edge 55. The edge 54 may be the perimeter of the second portion 50 of the conductive element 26 in the outer region 46. The inner edge(s) 55 enclose the slot 52.

The enclosed slot 52 has a length L substantially parallel to the vertical axis V and a width W substantially parallel to the horizontal axis H. As used herein, the term "substantially parallel" refers to no greater than 10° deviation between the paths of two axes. The term "substantially" is utilized herein to account for curvature of the window assembly 20. For example, the length L and width W of the enclosed slot 52 may be defined according to two axes relative to the enclosed slot 52. The axis of the length L of the enclosed slot 52 can be compared to the vertical axis V of the substrate 28 and the axis of the width W of the enclosed slot 52 can be compared to the horizontal axis H of the substrate 28 to make length L and width W measurements for the slot 52 and to determine the degree of parallelism. Those skilled in the art will understand that the curvature of the window assembly 20 is "substantially parallel" within the meaning of this specification.

The length L and width W of the enclosed slot 52 may have any suitable dimension. Furthermore, the dimensions of the enclosed slot 52 may be modified to tweak the resonant frequencies and/or effect on impedance matching conditions of a slot antenna 68. In one configuration, the length L of the enclosed slot 52 is in a range between 50-200 mm. In one specific configuration, the length L of the enclosed slot 52 is 100 mm.

Additionally, the width W of the enclosed slot 52 may be any suitable dimension. In one configuration, the width W of the enclosed slot 52 is in a range between 1-10 mm. It will be appreciated that the enclosed slot 52 may have multiple lengths L and widths W of varying dimensions. It will further be appreciated that the enclosed slot 52 may have any suitable length L and width W not specifically described herein.

Figure 8:
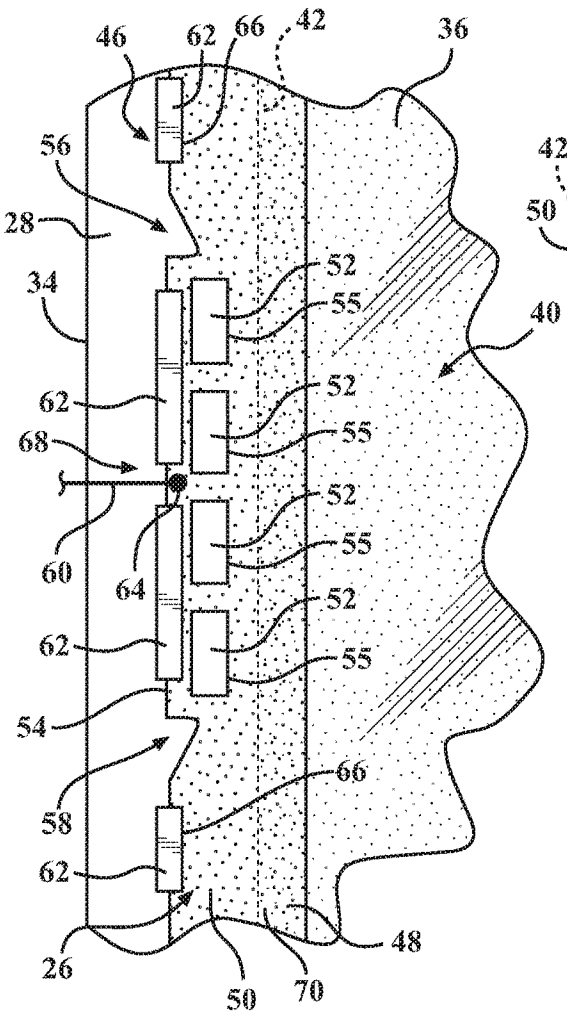
FIG. 8 is a plan view of the window assembly with the area of the second portion defining multiple enclosed slots, according to one example.

It will be appreciated that there may be more than one enclosed slot 52 with varying dimensions. In one configuration, as shown in FIG. 8, the second portion 50 of the conductive element 26 may include a plurality of enclosed slots 52 with similar dimensions. It will further be appreciated that the lengths L and widths W of the enclosed slot(s) 52 may have other dimensions not specifically described herein.

Figure 11:
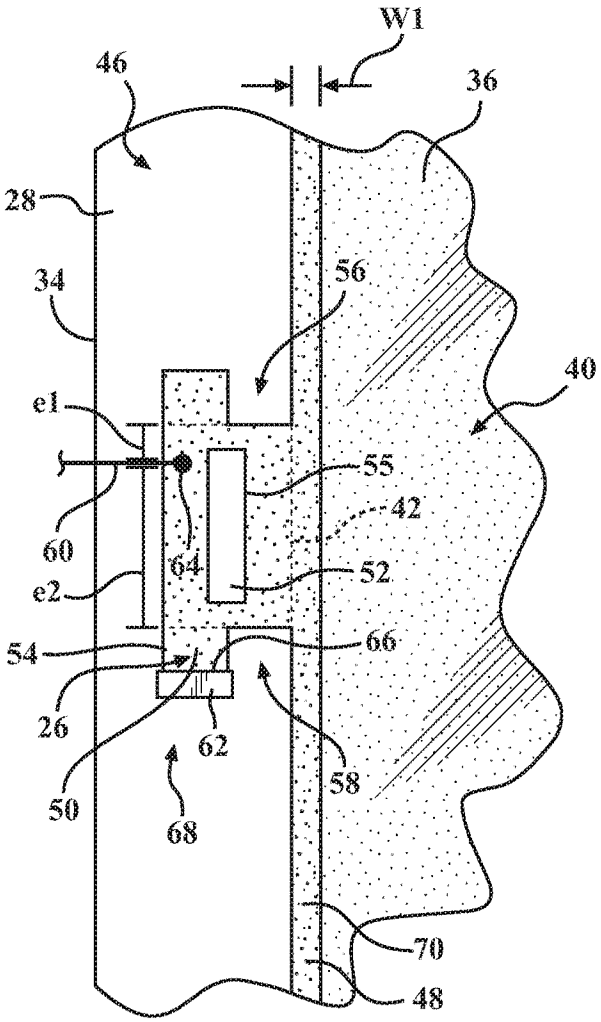
FIG. 11 is a plan view of the window assembly with the second portion having a width greater than a width of the first portion, according to one example.
Figure 13:
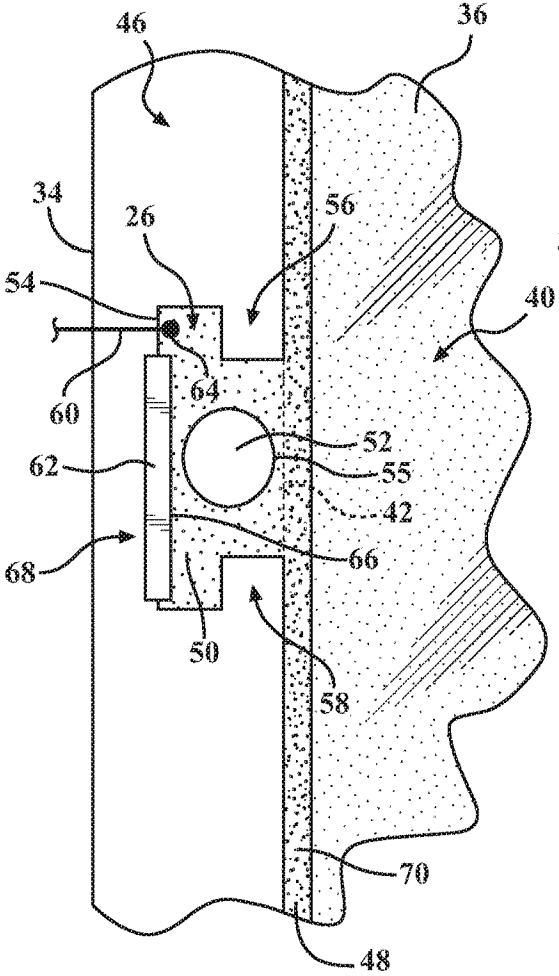
FIG. 13 is a plan view of the window assembly with the enclosed slot having a circular configuration, according to one example.
Figure 12:
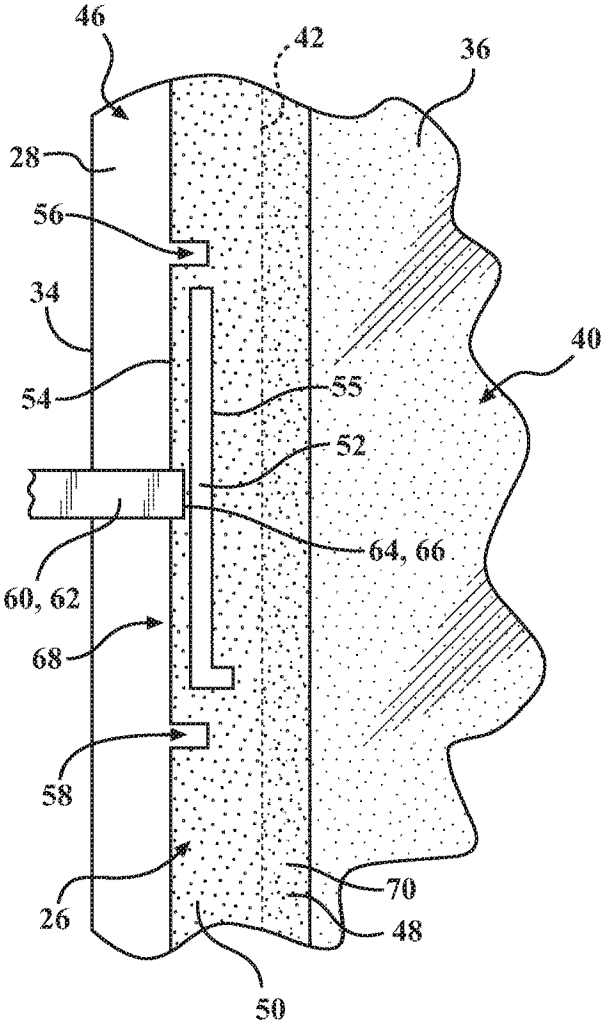
FIG. 12 is a plan view of the window assembly of with the enclosed slot having an L-shape configuration, according to one example.

The enclosed slot 52 may have any suitable configuration (shape, size, etc.), such as a rectangular-shaped configuration, as shown in FIGS. 8-11. In other examples, as shown in FIGS. 7 and 12, the enclosed slot 52 has an L-shaped configuration. In another configuration, as shown in FIG. 13, the enclosed slot 52 as a circular configuration. The enclosed slot 52 may have other configurations, including, but not limited to a circular or any polygonal configuration.

Figure 14:
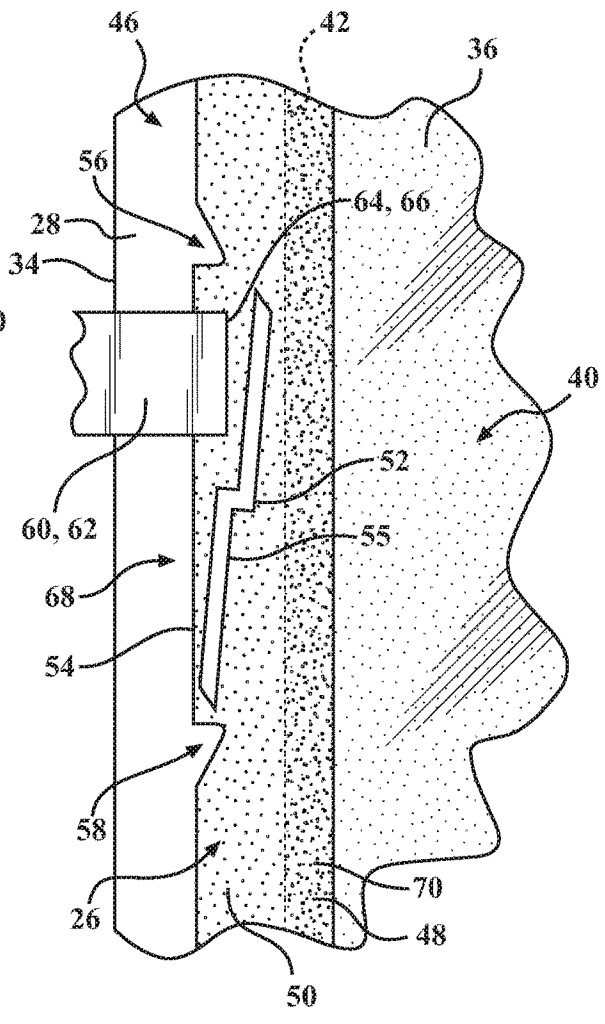
FIG. 14 is a plan view of the window assembly of with the enclosed slot being orientated according to a predetermined angle with respect to the periphery of the area of the transparent layer, according to one example.

As shown in FIG. 14, the enclosed slot 52 may have an angled configuration. The inner edge 55 of the enclosed slot 52 may extend at a predetermined angle θ. In one example, the edge 54 may be substantially parallel to the periphery 42 and the peripheral edge 34. In this example, the inner edge 55 of the enclosed slot 52 may have a predetermined angle θ substantially non-parallel to the periphery 42 and the peripheral edge 34. In one instance, the length(s) and width(s) of the enclosed slot 52 may have multiple varying predetermined angles θ. It will be appreciated that the enclosed slot 52 may have any angled configuration without departing from the scope of the invention.

The edge 54 of the second portion 50 may define a first groove 56 and a second groove 58 spaced apart from one another. The first and second grooves 56, 58 are isolated from one another. The grooves 56, 58 may be an opposing sides of the enclosed slot 52. The grooves 56, 58 are disposed entirely in the outer region 46. The second portion 50 may comprise any number of grooves.

Figure 10:
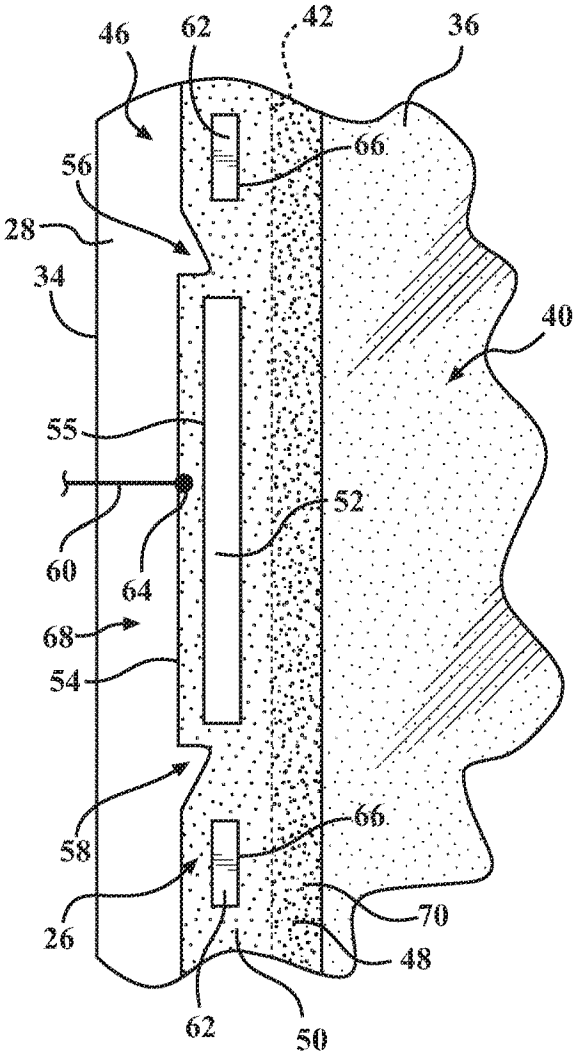
FIG. 10 is a plan view of the window assembly with the second portion having an edge defining the first groove and the second groove with the first and second grooves having a slope configuration, according to one example.

In one example, as shown in FIGS. 6, 7, 11, and 12, the grooves 56, 58 have a substantially rectangular configuration. Alternatively, the grooves 56, 58 may have any other suitable configuration, such as a semi-circular, slope (as shown in FIG. 10), or curve configuration. The grooves 56, 58 may have different configurations from one another. Alternatively, each groove may have substantially the same configuration.

As shown throughout the Figures, the window assembly 20 includes a feeding element 60. The window assembly 20 further includes an energizing element 62. The feeding element 60 and energizing element 62 both couple to the conductive element 26. For example, the feeding element 60 and the energizing element 62 may be coupled to the second portion 50 of the conductive element 26. In another configuration, the feeding element 60 and the energizing element 62 are coupled to the conductive element 26 at different locations. In some examples, the feeding element 60 and/or energizing element 62 may be disposed partially on the first portion 48 of the conductive element 26.

The feeding element 60 couples to the conductive element 26 at a location further defined as a feed point 64. The energizing element 62 couples to the conductive element 26 at a location further defined as an energizing point 66 (not shown). As will be described in detail below, the feeding element 60 energizes the conductive element 26 to implement the enclosed slot 52 as the slot antenna 68 and the energizing element 62 energizes the conductive element 26 to implement the conductive element 26 as a bus bar 70. The slot antenna 68 transmits and/or receives radio frequency signals and the bus bar 70 transfers energy to heat the transparent layer 36.

According to one configuration, the feeding element 60 is abutting and in direct electrical connection with the conductive element 26. The feeding element 60 may pass electrical current to the conductive element 26 directly through an electrically conductive material, such as a feeding strip or wire, physically attached to the conductive element 26. For example, the feeding element 60 may be directly wired or soldered to the conductive element 26. In one configuration, as shown in FIG. 4, the feeding element 60 is non-coplanar with the conductive element 26 and directly connected atop of the conductive element 26. In another configuration, the feeding element 60 is coplanar with the conductive element 26 and directly connected to the conductive element 26. The feeding element 60 may be connected to electrical wires or connectors extending along the peripheral edge 34 of the window assembly 20 such that the electrical wires or connectors are concealed from occupants of the vehicle 22. The feeding element 60 and conductive element 26 may be abutting and in direct electrical connection according to several other configurations with respect to the transparent layer 36 and the interlayer 38 not specifically illustrated throughout the Figures.

Alternatively, as shown in FIG. 5, the feeding element 60 may be spaced from and capacitively coupled to the conductive element 26. In such instances, the feeding element 60 induces electrical current to the conductive element 26 through a dielectric material, such as the exterior and interior substrates 30, 32 and the interlayer 38. When capacitively coupled, the feeding element 60 is neither hard-wired nor in direct contact with the conductive element 26 and is generally disposed non-coplanar with the conductive element 26. In one configuration, as shown in FIG. 5, the feeding element 60 is disposed on the outer surface P4 of the interior substrate 32 and capacitively coupled to the conductive element 26 disposed between the interlayer 38 and the inner surface P3 of the interior substrate 32. The feeding element 60 may be spaced from and capacitively coupled to the conductive element 26 on the window assembly 20 according to several other configurations with respect to the transparent layer 36 and the interlayer 38, which are not specifically illustrated throughout the Figures.

As referenced above, the conductive element 26 may be energized by the feeding element 60 to implement the enclosed slot 52 as the slot antenna 68. The feeding element 60 energizes the conductive element 26 by transferring an alternating current (AC) to the conductive element 26.

Figure 15:
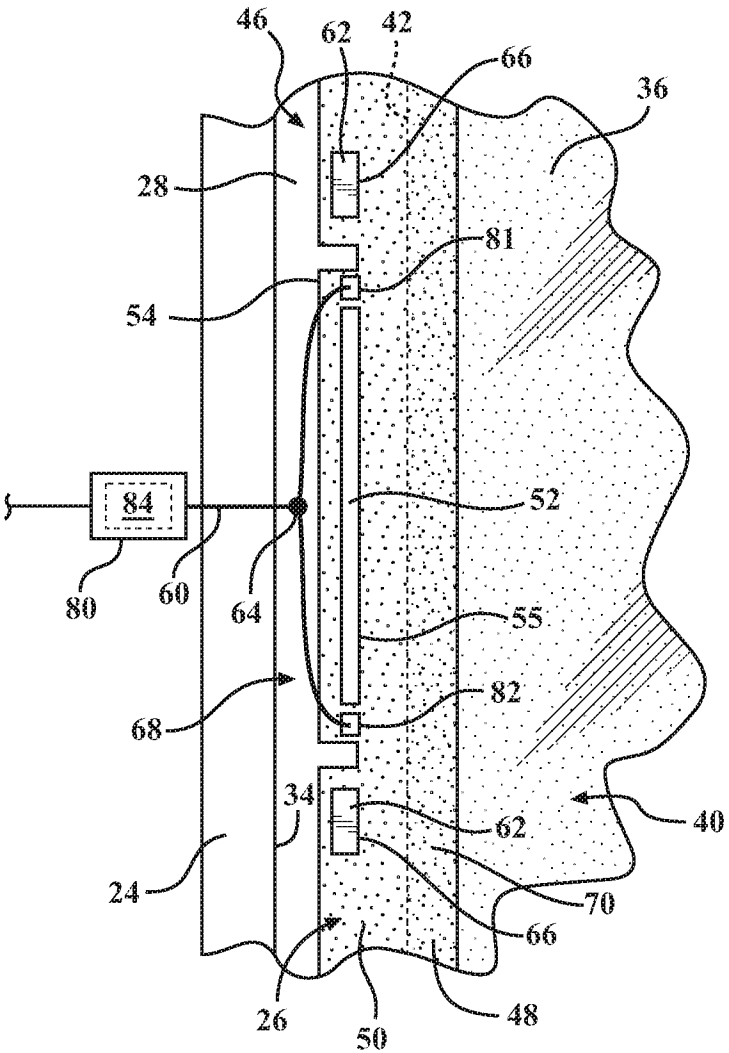
FIG. 15 is a plan view of the window assembly with the feeding element having an energizing conductor and a grounding conductor both coupled to a feed point at the conductive element and connected to an amplifier, according to one example.

The feeding element 60 may include any suitable configuration and material for energizing the conductive element 26. In one configuration, the feeding element 60 includes a coaxial line having an energizing conductor 81 coupled to the conductive element 26 and a grounding conductor 82 coupled to the conductive element 26. The energizing conductor 81 and the grounding conductor 82 are disposed adjacent to the enclosed slot 52. In one configuration, the conductors 81, 82 are disposed along the inner edge(s) 55 of the enclosed slot 52. As shown in FIG. 15, the energizing conductor 81 and the grounding conductor 82 are coupled to the feeding element 60 at the feed point 64.

Electrical grounding from the conductive element 26 occurs at an amplifier 80. As shown in FIG. 15, the energizing conductor 81 and the ground conductor 82 couple to the amplifier 80. As such, electrical grounding to the window frame 24 is avoided. In other configurations, the feeding element 60 includes a feeding strip, a feeding wire, or a combination of both. In addition, the feeding element 60 may be balanced or unbalanced coaxial cable, micro strip, or single wire line. Furthermore, the feeding element 60 may include any suitable feeding network for providing phase shifting to the radio frequency signal transmitted or received by the conductive element 26. The feeding element 60 may also couple to the conductive element 26 at a plurality of feed points 64.

In one example, the feeding element 60 is configured to energize the slot antenna 68 and the transparent layer 36 such that the slot antenna 68 and the transparent layer 36 collectively transmit and receive radio frequency signals. In one configuration, the feeding element 60 jointly energizes the slot antenna 68 and the transparent layer 36. The feeding element 60 is electrically coupled to the slot antenna 68 and the transparent layer 36 such that the slot antenna 68 and the transparent layer 36 operate as active antenna elements for excitation or reception of radio frequency signals.

As shown in FIG. 2, the window assembly 20 may further comprise a second conductive element 74 spaced apart from the first conductive element 26. The first and second conductive elements 26, 74 are disposed along at least one side edge of the periphery 42. It will be appreciated that the conductive elements 26 may be disposed along the upper and lower edges 42*a*, 42*b* of the periphery 42. The second conductive element 74 may have any of the features, capabilities, or configurations of the first conductive element 26 described herein. The window assembly 20 may include any number of conductive elements.

The window assembly 20 may further comprise a second feeding element 60*a*. The second feeding element 60*a* may couple to the second conductive element 74. The second conductive element 74 may be energized by the second feeding element 60*a* to implement the enclosed slot 52 of the second conductive element 74 as a second slot antenna 68*a*. The second feeding element 60*a* may include any capabilities, configurations of the first feeding element 60.

In one configuration, the first conductive element 26 and the second conductive element 74, implemented as slot antennas 68, 68*a*, may collectively transmit or receive linearly polarized radio frequency signals. For instance, the slot antennas 68, 68*a* may be one or more of an AM, FM, DAB (Digital Audio Broadcasting), TV antenna, and the like.

Furthermore, the first conductive element 26 and the second conductive element 74 are configured collectively to operate in diversity such that an optimal one of the radio frequency signals received by the first and second conductive elements 26, 74 can be selected. In such instances, the enclosed slots 52 may be configured to receive signals of the same frequency range, or for the same application. A controller 84, such as a signal processor, may connect to the conductive elements 26. The controller 84 may be coupled to, or incorporated in the amplifier 80. The signal processor is configured to select or combine radio frequency signals transmittable or receivable by the conductive elements 26. By doing so, the conductive elements 26 may operate in diversity. By operating in diversity, the conductive elements 26 transmit and/or receive radio frequency signals in multiple directions within a field of reception to minimize interference and temporary fading of the signal.

Alternatively, the enclosed slots 52 may operate to receive/transmit signals of different frequency or range. For instance, the enclosed slot 52 of the first conductive element 26 may be sized such that the enclosed slot 52 receives TV signals while the enclosed slot 52 of the second conductive element 74 may be sized such that the enclosed slot 52 receives FM signals. Generally, each of the enclosed slots 52 is configured to allow transmission and/or reception of one type of antenna frequency application. However, each of the enclosed slot 52 may be utilized for more than one type of antenna frequency application.

Figure 9:
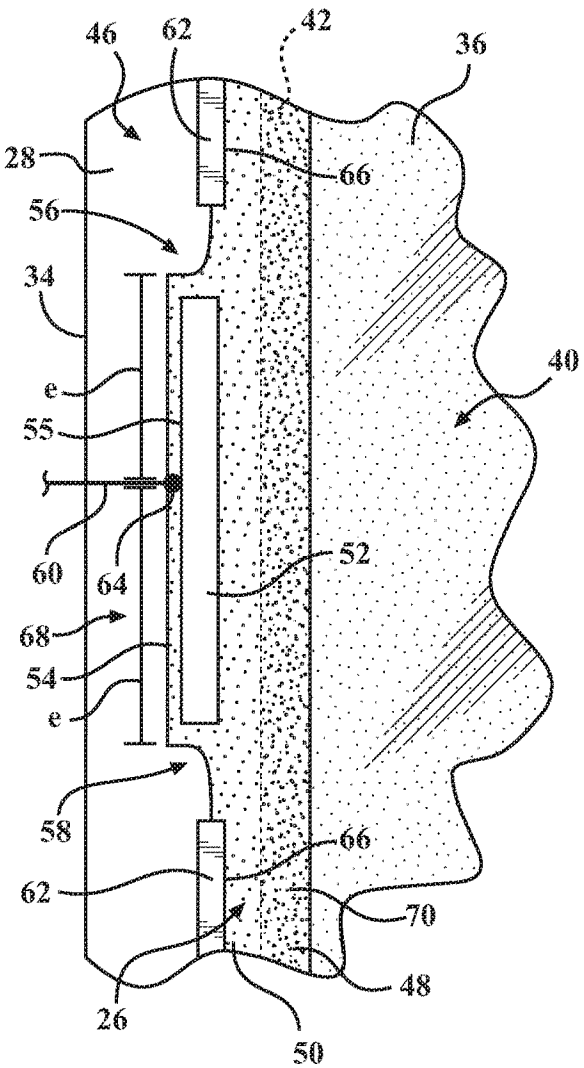
FIG. 9 is a plan view of the window assembly with the conductive element abutting and being in direct electrical connection with the feeding element between the first and second grooves of the edge of the second portion and an energizing element coupled the second portion, according to one example.

Antenna performance is further fine-tuned based upon the dimensioning of the grooves 56, 58, the feeding element 60, positioning of such in relation to grooves 56, 58 of the edge 54 of the second portion 50 of the conductive element 26, and the transparent layer 36. As shown in FIG. 9, one example of such positing and dimensioning of the feeding element 60 includes a distance "e" between the feed point 64 of the feeding element 60 and any one or plurality of the grooves 56, 58 of the edge 54 of the second portion 50 of the conductive element 26. In FIG. 11, the distance "e1" between the feed point 64 and the first groove 56 is different from the distance "e2" between the feed point 64 and the second groove 58. It will be appreciated that the feeding element 60 may be posited and dimensioned in any suitable configuration. It will be further appreciated that the feeding element 60 may be posited and/or dimensioned in any suitable location on the second portion 50 of the conductive element 26. For instance, the feeding element 60 may be positioned between the first groove 56 and the second groove 58. In another instance, as shown in FIG. 13, the feeding element 60 may not be positioned between the grooves 56, 58.

The grooves 56, 58 may operate to provide impedance matching by matching impedance of the conductive element 26 and the transparent layer 36 to an impedance of a cable or circuit. The cable, for example, may be a cable, such as a coaxial cable, that is connected to the feeding element 60 that energizes the conductive element 26. The circuit, for example, may be the amplifier 80 that connects the conductive element 26 through a cable or lead wire, and the like. Additionally, the amplifier 80 provides for an electrical grounding of the conductive element 26 such that electrical grounding occurs away from the window frame 24.

In one configuration, the feeding element 60 and the energizing element 62 may be integrated into a single component. The single component including the feeding element 60 and the energizing element 62 may be readily removed and attached to the window assembly 20. The single component may have a substantially flat configuration such that the signal component may be easily sandwiched between the interior and the exterior substrates 30, 32. The single component may include a mating connector for connecting the corresponding electrical system, such as the electrical system of the vehicle 22, and the like.

As referenced above, the conductive element 26 may be energized by the energizing element 62 such that the conductive element 26 is implemented as the bus bar 70. The second conductive element 74 may be energizing by a second energizing element 62*a* such that the second conductive element 74 is implemented as a second bus bar 70*a*. The energizing elements 62, 62*a* are coupled to the second portion 50 of the conductive element 26. The energizing elements 62, 62*a* may have any suitable configuration. There may be a plurality of energizing elements 62 (i.e. 62*a*, 62*b*, and so on). With respect to the energizing element(s) 62, the term "energize" is understood to describe an electrical relationship between the energizing element(s) 62 and the bus bar(s) 70 and the transparent layer 36 whereby the energizing element(s) 62 excites the bus bar(s) 70 to transfer energy to the transparent layer 36 to heat the transparent layer 36. The energizing elements 62, 62*a* energizes the first and second conductive elements 26, 74 by applying DC current. The DC current may be facilitated by a DC voltage source being in a range between 12 volts to 48 volts.

The transparent layer 36 may be energizable as a defrosting or defogging element. For example, the first conductive element 26 may be implemented as the bus bar 70 and the second conductive element 74 may be implemented as the second bus bar 70*a*. The bus bar 70 is disposed on one of the side edges 42*c* or 42*d* of the periphery 42 and the second bus bar 70*a* is disposed on the opposing side edge 42*c* or 42*d* of the periphery 42, respectively. Alternatively, the bus bar 70 may be disposed on the upper edge 42*a* of the periphery 42 and the second bus bar 70*a* may be disposed on the lower edge 42*b* of the periphery 42, or vice-versa. The bus bar 70 and the second bus bar 70*a* are coupled to the transparent layer 36. In one instance, the bus bar 70 is connected to a positive terminal of a battery of the vehicle 22 and the second bus bar 70*a* is connected to the vehicle body and ultimately to a ground terminal of a battery of the vehicle 22, or vice-versa. Electrical current passes from one of the bus bars 70, 70*a*, through the transparent layer 36, and exits through the other one of the bus bars 70, 70*a* to energize the transparent layer 36. Ultimately, the electrical current passing through the transparent layer 36 heats the transparent layer 36 such that the transparent layer 36 can effectively defrost or defog. The transparent layer 36 may be energizable as a defrosting or defogging element according to various other methods and configurations. Additionally, the bus bars 70, 70*a* may be have suitable configuration not specifically recited herein.

In one configuration, the first conductive element 26 may be implemented as the slot antenna 68 and the bus bar 70 and the second conductive element 74 may be implemented as the bus bar 70. It will be appreciated that the conductive element(s) 26, 74 may be implemented as any combination of the slot antenna 68 and/or the bus bar 70. Moreover, any of the techniques described herein may be utilized with the first conductive element 26 alone, such that the second conductive element 74 is not utilized.

The window assembly 20 may also include a plurality of conductive elements 26, a plurality of feeding elements 60, and a plurality of energizing elements 62. In one configuration, a single feeding element 60 is coupled to a single conductive element. Such configurations may be defined as a single-port configuration. Alternatively, the single feeding element 60 may connect to the conductive element 26 at a plurality of feed points 64. In such configurations, the feeding element 60 may include a conductor coupled to each feed point 64. The conductors may be connected, or spliced together, such that a single conductor is required to enter the feeding element 60 for energizing the conductive element 26 at the plurality of feed points 64. In yet another configuration, a single feeding element 60 is coupled to a plurality of conductive elements 26. Such configurations may be defined as a multi-port configuration. In such instances, the feeding element 60 may connect to each of the conductive elements 26 at a separate feed point 64. In such configurations, the single feeding element 60 may include separate conductors each coupled to each separate conductive element. In such instances, the feeding element 60 effectively operates at two separate feeding elements 60 consolidated into a single feeding unit. The feeding element 60 may couple to various other parts of the conductive element 26. It will be appreciated that in these configurations, the feeding element 60 may be integrated with the energizing element 62 as a single component.

It will be further appreciated that the terms "include," "includes," and "including" have the same meaning as the terms "comprise," "comprises," and "comprising."

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention is intended to be defined in the independent claims, with specific features laid out in the dependent claims, wherein the subject-matter of a claim dependent from one independent claim can also be implemented in connection with another independent claim where present.

The invention claimed is:

1. A window assembly comprising:

a substrate;

a transparent layer disposed on the substrate and defining an area having a periphery and with the transparent layer comprising a metal compound such that the transparent layer is electrically conductive;

an outer region devoid of the transparent layer defined adjacent the transparent layer along the periphery;

a conductive element disposed on the substrate and comprising:

a first portion overlapping the area of the transparent layer and abutting and being in direct electrical contact with the transparent layer; and a second portion integrally extending from the first portion and disposed in the outer region such that the periphery delineates the first portion from the second portion, and wherein the second portion has an area defining an enclosed slot, and wherein the second portion comprises an edge wherein the edge defines a first groove and a second groove spaced apart from one another and being disposed on opposing sides of the enclosed slot;

a feeding element coupled to the conductive element and being configured to energize the conductive element to implement the enclosed slot as a slot antenna; and an energizing element coupled to the conductive element and being configured to energize the conductive element to implement the conductive element as a bus bar configured to transfer energy to the transparent layer to heat the transparent layer.

2. The window assembly of claim 1, wherein:

the substrate defines an area bound by a peripheral edge of the substrate;

the outer region is defined between the periphery of the transparent layer and the peripheral edge of the substrate, and the outer region entirely surrounds the periphery of the transparent layer; and the transparent layer occupies at least a majority of the area of the substrate.

3. The window assembly of claim 1, wherein the periphery defines an upper edge, a lower edge, and two opposing side edges, and with a vertical axis extending vertically between the upper and lower edges and a horizontal axis extending horizontally between the opposing side edges, wherein the enclosed slot has a length substantially parallel to the vertical axis and a width substantially parallel to the horizontal axis and wherein the length of the enclosed slot is in a range between 50 millimeters to 200 millimeters and the width of the enclosed slot is in a range between 1 millimeter to 10 millimeters.

4. The window assembly of claim 1, wherein the periphery defines an upper edge, a lower edge, and two opposing side edges, wherein the conductive element is first conductive element disposed on one of the side edges of the periphery and further comprising a second conductive element disposed on the opposing side edge of the periphery.

5. The window assembly of claim 4, wherein:

the second conductive element comprises a first portion overlapping the area of the transparent layer and abutting and being in direct electrical contact with the transparent layer and a second portion integrally extending from the first portion and disposed in the outer region such that the periphery delineates the first portion from the second portion, and wherein the second portion of the second conductive element has an area defining a second enclosed slot; and further comprising a second feeding element coupled to the second conductive element and being configured to energize the second conductive element to implement the second enclosed slot as a second slot antenna.

6. The window assembly of claim 5, wherein the first and second conductive elements are each configured to receive radio frequency signals and to collectively operate in diversity such that an optimal one of the radio frequency signals received by the first and second conductive elements can be selected.

7. The window assembly of claim 4, further comprising a second energizing element coupled to the second conductive element and being configured to energize the second conductive element to implement the second conductive element as a second bus bar and wherein the first and second conductive elements are collectively configured to transfer energy through the transparent layer.

8. The window assembly of claim 1, wherein the substrate further comprises an exterior substrate and interior substrate and wherein the transparent layer and the conductive element are sandwiched between the exterior and interior substrates.

9. The window assembly of claim 1, wherein the first and second grooves are configured to steer electrical current provided by the energizing element towards the transparent layer to heat the transparent layer.

10. The window assembly of claim 1, wherein the first and second grooves are configured to provide impedance matching and/or radiation pattern altering for the slot antenna.

11. The window assembly of claim 1, wherein the feeding element is coupled to the second portion.

12. The window assembly of claim 1, wherein the feeding element comprises an energizing conductor and a grounding conductor and wherein the energizing and grounding conductors are both coupled to the conductive element.

13. The window assembly of claim 11, wherein the energizing element is coupled to the second portion.

14. The window assembly of claim 1, wherein the feeding element is further configured to energize the transparent layer such that the slot antenna and the transparent layer collectively are configured to transmit and/or receive radio frequency signals.

15. The window assembly of claim 1, wherein the conductive element comprises metallic print.

16. The window assembly of claim 1, wherein the edge of the second portion defines at least one of the first and second grooves with a sloped or curved configuration.

17. The window assembly of claim 1, wherein the first and second grooves are identical to one another in shape and dimension.

18. The window assembly of claim 1, wherein the first groove is spaced from the enclosed slot by a first distance and the second groove is spaced apart from the enclosed slot by a second distance, and wherein the first distance is equal to the second distance.

19. The window assembly of claim 18, wherein the first and second grooves comprise shapes that are symmetrical to one another relative to a line of symmetry defined through a center of the enclosed slot.

20. The window assembly of claim 1, wherein the first groove is spaced from the feeding element by a first distance and the second groove is spaced apart from the feeding element by a second distance, and wherein the first distance is equal to the second distance.

* * * * *